US005966943A

United States Patent [19]

Mitchell

[11] Patent Number: 5,966,943

[45] Date of Patent: Oct. 19, 1999

[54] PULSE TUBE REFRIGERATOR

[76] Inventor: Matthew P. Mitchell, 151 Alvarado Rd., Berkeley, Calif. 94705

[21] Appl. No.: 08/996,227

[22] Filed: Dec. 22, 1997

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 5,414,997 | 5/1995 | Tailer | 60/510 |
| 5,642,623 | 7/1997 | Hiresaki et al. | 62/6 |
| 5,689,959 | 11/1997 | Yatsuzuka et al. | 62/6 |
| 5,791,149 | 8/1998 | Dean | 62/6 |
| 5,794,450 | 8/1998 | Alexander | 62/6 |

OTHER PUBLICATIONS

Walker, Industrial Heat Exchangers, 1990, pp. 211–220 (Hemisphere Publishing Corp., N.Y., Wash., Phila., London).

Zhu, et al., "Phase Shift Effect of the Long Neck Tube for the Pulse Tube Refrigerator", Cryocoolers9, 1996, pp. 269–278 (Plenum Press).

Gardner, et al. "Use of Inertance in orifice pulse tube refrigerators" Cryogenics, Feb. 1997, pp. 117–121 (Elsevier Science, Ltd. G. B.).

Grosser, Gossamer Odyssey, 1981, pp. 87–88 & pp. 164–167 (Houghton Mifflin, Boston).

Lambie, "Gossamer Albatross," Soaring, Aug. 1979, p. 19 (Soaring Society of America, Los Angeles).

*Primary Examiner*—Ronald Capossela

[57] ABSTRACT

A pulse tube refrigerator is equipped with a constant-diameter inertance tube (41) or a stepped or tapered inertance tube (48) which is coiled in a reservoir (20) to protect it from damage from external impacts and from structural failure due to differences between external and internal pressures. A tapered inertance tube (48) improves thermodynamic performance of the pulse tube refrigerator by improving heat transfer at the warm end of pulse tube (10).

17 Claims, 3 Drawing Sheets

PULSE TUBE REFRIGERATOR

BACKGROUND—FIELD OF INVENTION

This invention relates to pulse tube refrigerators, including pulse tube cryocoolers, and specifically to pulse tube refrigerators equipped with reservoirs and inertance tubes.

BACKGROUND—DESCRIPTION OF PRIOR ART

Pulse tube refrigerators are a variation on a class of regenerative refrigerators that includes Stirling cycle and Gifford-McMahon refrigerators. Stirling and Gifford-McMahon refrigerators use displacers to move a pressurized fluid (usually helium) through their regenerators and reject heat through a single warm heat exchanger location. Some distinguishing characteristics of a pulse tube refrigerator are that it has no mechanical displacer and that it rejects heat at two separate places.

Pulse tube refrigerators operate by cyclically compressing and expanding fluid in conjunction with fluid movement through heat exchangers. In the prior art orifice pulse tube refrigerator shown in FIG. 1, an orifice connects the warm end of the pulse tube to a reservoir, allowing some fluid to flow from the pulse tube through a warm heat exchanger into the reservoir when pressure in the pulse tube is higher than the pressure in the reservoir, and to return by the same route when pressure in the pulse tube falls below pressure in the reservoir. Reservoir mean pressure is typically similar to mean pressure in the pulse tube and varies less over the cycle than does the pressure in the pulse tube.

The orifice and reservoir serve to control flows at the warm end of the pulse tube so that they are not in phase with flows at the cold end. That is, the flow at the warm end of the pulse tube from the pulse tube toward the reservoir occurs at all times when pressure in the pulse tube is higher than pressure in the reservoir. Thus, flow from pulse tube to reservoir continues even after flow into the cold end of the pulse tube has ceased and outflow has begun, until pressure in the pulse tube drops below pressure in the reservoir.

Similarly, when pressure in the reservoir is higher than pressure in the pulse tube, fluid flows from reservoir to pulse tube. That is true not only when fluid is leaving the cold end of the pulse tube and pressure in the pulse tube is falling but also during the first part of the subsequent inflow of fluid at the cold end of the pulse tube until pressure in the pulse tube equals and exceeds pressure in the reservoir.

Over the cycle in an orifice pulse tube refrigerator, the flows, in sequence are approximately as follows:

1. Inflows to the pulse tube at both ends;
2. Continued inflow at the cold end; outflow at the warm end;
3. Outflow at the cold end; continued outflow at the warm end; and
4. Continued outflow at the cold end; inflow at the warm end (after which the cycle repeats).

With an orifice and reservoir, it is possible to obtain about 90 degreees of phase difference between flows at the warm and cold ends of a pulse tube. Performance of the orifice pulse tube can be improved by altering the phasing of flows so that fluid continues to flow from reservoir to pulse tube even when pressure in the pulse tube has risen above reservoir pressure and so that fluid continues to flow from pulse tube to reservoir even when pressure in the pulse tube has fallen below reservoir pressure. That objective can be accomplished with a prior art inertance tube as illustrated in FIG. 2.

In prior art pulse tube refrigerators equipped with inertance tubes, the reservoir is a separate component attached to one end of the inertance tube. It is typically a metal cylinder with a narrow opening at one end. One end of the inertance tube is connected to the end of the reservoir cylinder. The other end of the inertance tube is connected to the warm end of the pulse tube.

In prior art pulse tube refrigerators equipped with inertance tubes, the inertance tubes are empty tubes of length and constant diameter appropriate to the size and operating speed of the pulse tube refrigerator. Inertia of the fluid moving in the tube keeps it moving past the time when reversing pressure relationships would otherwise have caused flow to have reversed direction. Typical lengths are several meters for pulse tube refrigerators cycling at 60 Hz and longer for slower operating speeds. In small pulse tube refrigerators with volumes of a few ml in the pulse tube itself, inertance tubes replace both the orifice and the warm heat exchanger of the orifice pulse tube refrigerator of FIG. 1. In larger pulse tube refrigerators, a separate warm heat exchanger rejects heat while the inertance tube serves primarily to shift phase.

The drawbacks of inertance tubes are bulk weight and pressure drop. Straight, unenclosed inertance tubes several meters long are awkward excrescences on otherwise-compact refrigerators. Unenclosed inertance tubes must be sturdy enough to withstand external impacts that they are likely to sustain during installation and operation. Since they must contain the whole pressure of the system, unenclosed inertance tubes must be strong, and thus heavy. If an unenclosed inertance tube cracks or breaks, the fluid in the pulse tube refrigerator leaks out, depressurizing it and disabling it.

Constant-diameter inertance tubes present another problem in small pulse tube refrigerators in which they combine the functions of heat exchanger and phase shifter. The phase-shifting function is best served by minimizing flow friction, which can be accomplished by using a large-diameter tube. However, heat transfer is enhanced by using a small-diameter tube. There is no satisfactory compromise between these conflicting objectives with a constant-diameter inertance tube.

OBJECTS AND ADVANTAGES

Thus, the objects and advantages of this invention include the following:

The pulse tube refrigerator can be improved by using an inertance tube of varying diameter, with the larger diameter of the inertance tube adjacent to the pulse tube and the smaller diameter adjacent to the reservoir. In that configuration, warm fluid flows toward the narrower portion of the inertance tube with increasing heat transfer effectiveness while pressure is high and the fluid is hot. Fluid flows toward the broader portion of the inertance tube where heat transfer is less effective while pressure and fluid temperature are lower. The overall effect is to improve heat transfer by facilitating it at times when heat transfer is desired and inhibiting heat transfer at times when it is not desired. Tapering the inertance tube also reduces viscous (pressure-drop) losses in the inertance tube and thus enhances its phase-shifting function. A practical method of creating a tube with a thin wall and a tapered internal diameter is to differentially etch the walls of a thick-walled tube so as to taper both the outer and inner surfaces.

A preferred embodiment places a coiled, tapered inertance tube inside a reservoir, with a free end of the inertance tube open-ended. The free end of the inertance tube vents into the reservoir through a bell mouth. Since the inertance tube is enclosed inside a pressurized chamber, it need only be strong enough to withstand the momentary differences between the pressure of the fluid inside the inertance tube and the pressure of the fluid in the reservoir.

Because the enclosed inertance tube is shielded from external impacts, the inertance tube may be made far lighter than it would have to be in the prior art configuration. With the inertance tube inside the reservoir, any crack or break in the inertance tube does not cause any loss of fluid from the pulse tube refrigerator, which remains pressurized.

Containing the inertance tube inside the reservoir almost entirely eliminates its bulk, since the volume of the inertance tube is typically small relative to the volume of the reservoir so that the size of the reservoir need not be significantly altered to accomodate the coiled inertance tube. This approach has the further advantage that a properly-shaped bell mouth can produce smooth flow of fluid into and out of the free end of the inertance tube, reducing pressure drop losses. By placing the coiled inertance tube in good thermal contact with the walls of the reservoir, heat from the inertance tube may be readily conducted to and dissipated from the large external surface area of the reservoir.

Thus several specific objects and advantages of this invention are:

(a) To provide an inexpensive, easily-fabricated phase shifting and heat rejecting system for a pulse tube refrigerator.

(b) To provide a light weight inertance tube for a pulse tube refrigerator.

(c) To provide a light weight, high-performance pulse tube refrigerator.

(d) To provide a compact combination of inertance tube and reservoir.

(e) To provide protection for an inertance tube against external impacts.

(f) To protect a pulse tube refrigerator from depressurization due to cracks or breaks in its inertance tube.

(g) To provide a high-performance inertance tube with high heat transfer capacity and low pressure drop characteristics for use in a pulse tube refrigerator.

Further objects and advantages will become apparent from a consideration of the ensuing description and drawings.

DRAWING FIGURES

REFERENCE NUMERALS IN DRAWINGS

Figure 1:
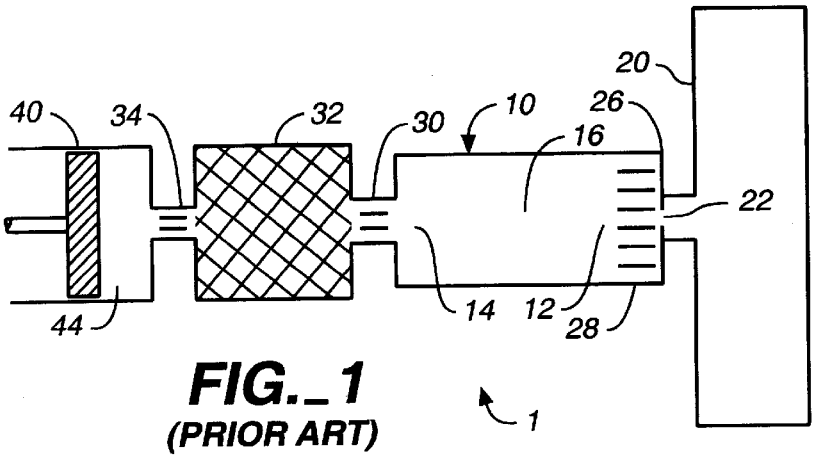
FIG. 1 (PRIOR ART)
FIG. 1 is a schematic view of a prior art orifice pulse tube refrigerator.

1 orifice pulse tube refrigerator
2 pulse tube refrigerator with inertance tube
3 pulse tube refrigerator with inertance tube coiled in reservoir
5 pulse tube refrigerator equipped with tapered inertance tube
10 pulse tube
12 warm fluid
14 cold fluid
16 plug of stratified fluid
19 diffuser/nozzle
20 reservoir
21 reservoir shell
22 orifice
26 warm end of pulse tube
28 warm heat exchanger
30 cold heat exchanger
32 regenerator
34 aftercooler
40 compressor
41 inertance tube
42 bell mouth
44 compression space
48 tapered inertance tube
50 joint
52 end-plug
60 etchant container
62 etchant
64 etchable tube
66 etchant-proof coating
68 etchant-proof plug
70 tapered bore

SUMMARY

In accordance with the present invention, an inertance tube for a pulse tube refrigerator may be tapered and may be coiled and enclosed in a reservoir.

Description—FIGS. 1–8

FIG. 1 is a schematic illustration of a prior art orifice pulse tube refrigerator 1. A working fluid such as helium is confined in a compression space 44, aftercooler 34, regenerator 30, pulse tube 10, warm heat exchanger 28, orifice 22 and reservoir 20. A compressor 40 sends an oscillating pressure wave in the fluid through aftercooler 34, regenerator 32, and cold heat exchanger 30 into pulse tube 10. Pulse tube 10 communicates with reservoir 20 through orifice 22, which may be a hole, a capillary tube or an adjustable valve. Warm fluid 12 passes through warm heat exchanger 28 as it flows back and forth through orifice 22 between pulse tube 10 and reservoir 20. Orifice 22 controls the amount of flow to and from reservoir 20. At the other end of pulse tube 10, cold fluid 14 passes back and forth between pulse tube 10 and regenerator 32 through cold heat exchanger 30. Warm fluid 12 and cold fluid 14 are separated by a plug of stratified fluid 16 that oscillates back and forth in pulse tube 10 but never leaves it. That plug of stratified fluid 16 contains a temperature gradient.

Figure 2:
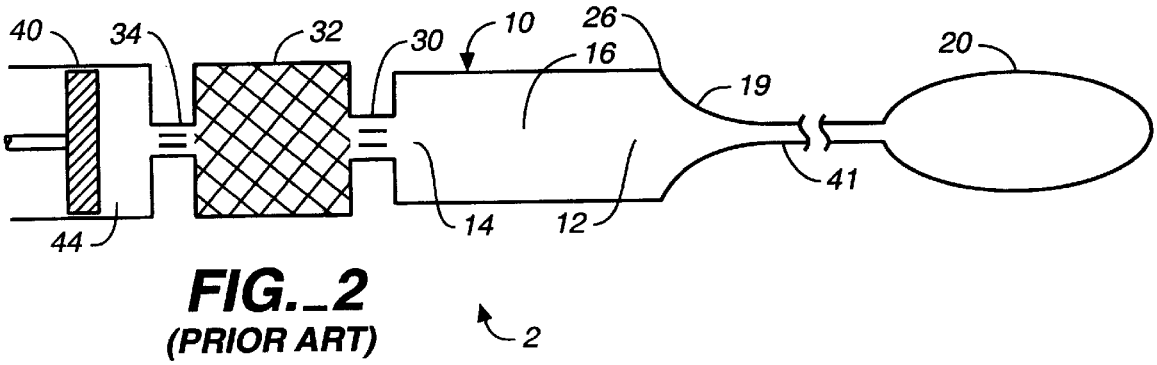
FIG. 2 (PRIOR ART)
FIG. 2 is a schematic view of a prior art pulse tube refrigerator equipped with an inertance tube.

FIG. 2 is a schematic illustration of a prior art pulse tube refrigerator 2 equipped with an inertance tube 41. This pulse tube refrigerator is generally the same as the orifice pulse tube refrigerator of FIG. 1 except that it has no warm heat exchanger or orifice as such. Instead, warm end 26 of pulse tube 10 is connected to reservoir 20 through a diffuser nozzle 19 and an inertance tube 41.

Figure 3:
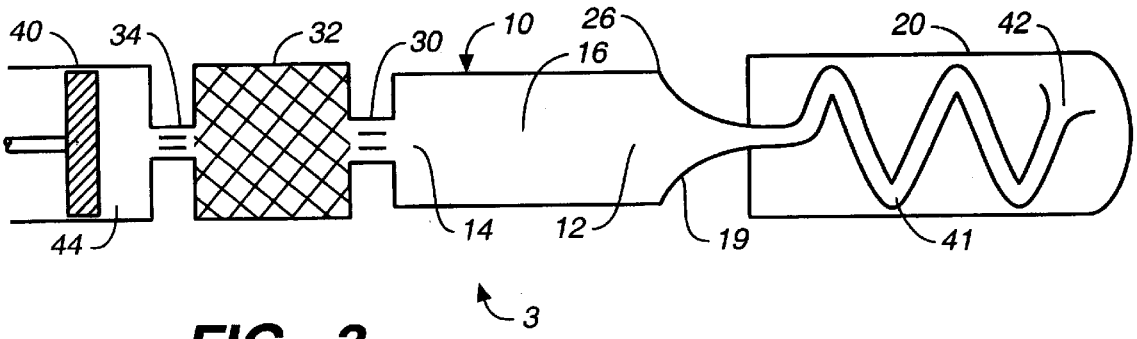
FIG. 3 is schematic view of a pulse tube refrigerator equipped with an inertance tube coiled in the reservoir.

FIG. 3 is schematic illustration of an embodiment of a pulse tube refrigerator 3 with inertance tube 41 coiled inside reservoir 20. One end of inertance tube 41 communicates with pulse tube 10 through diffuser/nozzle 19. The other end of inertance tube 41 is free, and communicates with the internal space of reservoir 20 through bell mouth 42.

Figure 4A:
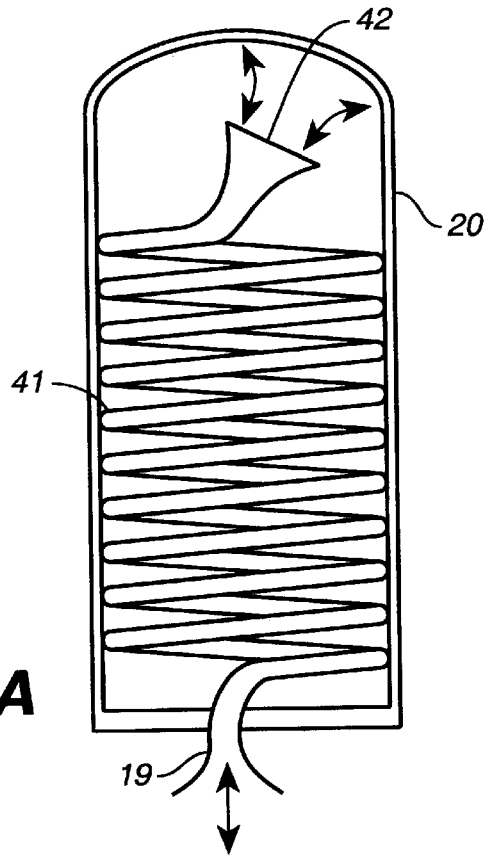
FIG. 4A is a schematic view of an inertance tube coiled in spiral configuration in a reservoir.

FIG. 4A is a cutaway view of reservoir 20 as shown in FIG. 3 containing an inertance tube 41 terminating in a bell mouth 42. FIG. 4A illustrates a configuration that maximizes contact of the outer surface of the inertance tube 41 and the inner surface of the reservoir 20.

Figure 4B:
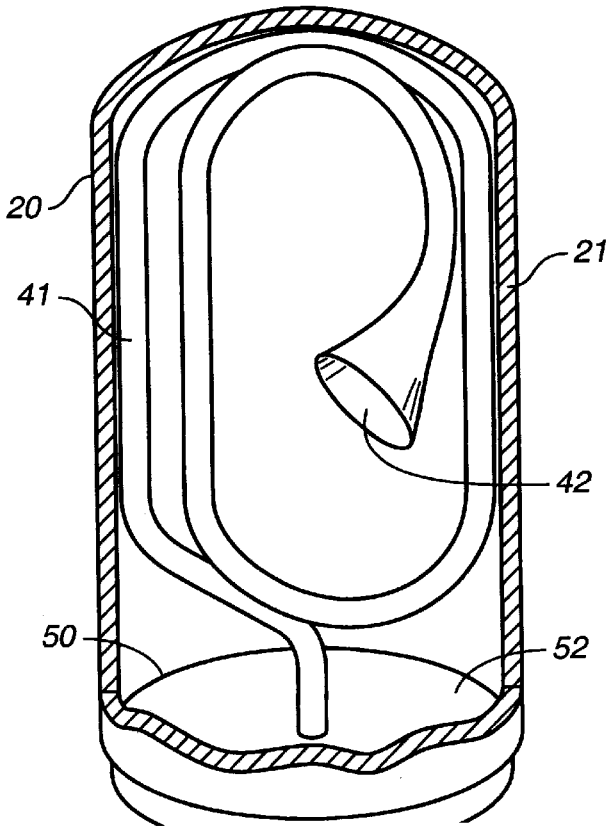
FIG. 4B is a cutaway perspective view of a reservoir containing an inertance tube folded to maximize straight lengths of tubing.

FIG. 4B is a cutaway perspective view of an alternate method of enclosing inertance tube 41 in reservoir 20. Inertance tube 41 is oriented to maximize the length of straight portions between curved portions of inertance tube 41. Bell mouth 42 of inertance tube 41 is oriented so that fluid flowing into and out of reservoir 20 will move freely in all directions in the reservoir space. The other end of inertance tube 41 is connected to a pulse tube (not shown) by any convenient means known to the art.

Figure 5:
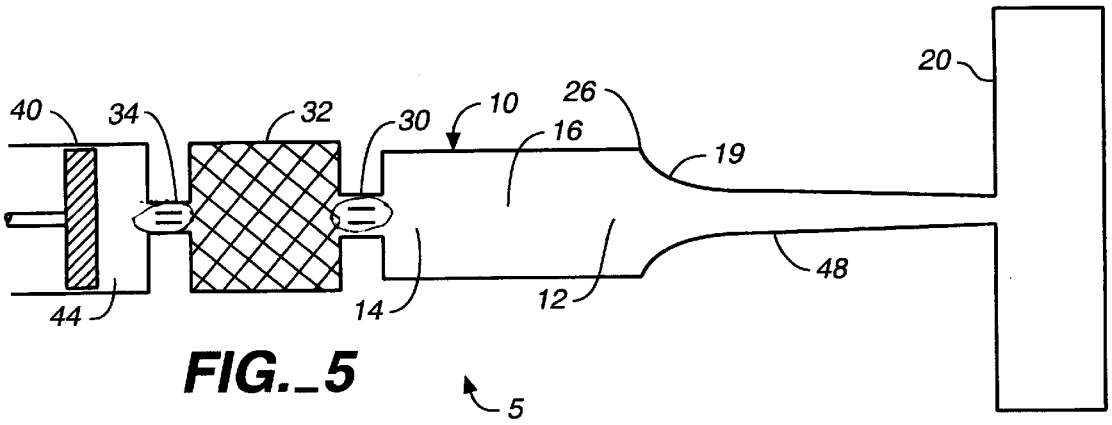
FIG. 5 is a schematic view of a pulse tube refrigerator equipped with a tapered inertance tube.

FIG. 5 is a schematic view of a pulse tube refrigerator in which pulse tube 10 is connected to reservoir 20 through a tapered inertance tube 48. For example, in a preferred embodiment in a pulse tube refrigerator operating at 60 Hz with a volumetric flow of about 3 ml of helium through diffuser nozzle 19 at warm end 26 of pulse tube 10, the diameter of inertance tube 48 should be of the order of 4 mm at its end adjacent to diffuser nozzle 19 and 2 mm at its end adjacent to reservoir 20. Optimum dimensions for varying operating speeds, temperatures, pressures and flow volumes can be determined by computational and experimental methods known to the art.

Figure 6:
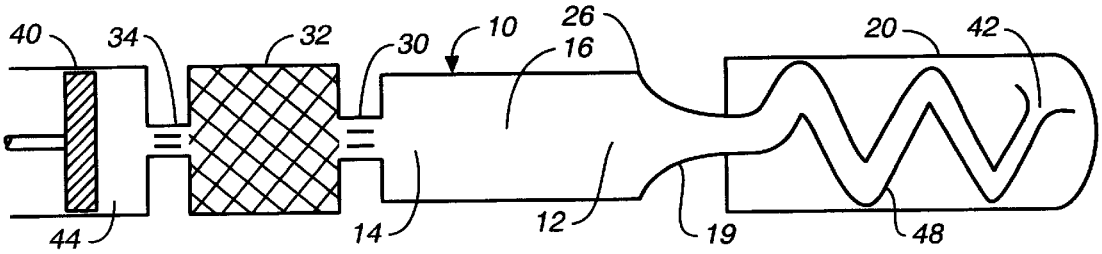
FIG. 6 is a schematic view of a pulse tube refrigerator equipped with a tapered inertance tube coiled in a reservoir.

FIG. 6 is a schematic view of a pulse tube refrigerator of this invention equipped with tapered inertance tube 48 coiled inside reservoir 20. One end of tapered inertance tube 48 communicates with pulse tube 10 through diff-user/nozzle 19. The other end of inertance tube 48 is free, and communicates with the internal space of reservoir 20 through bell mouth 42.

Figure 7:
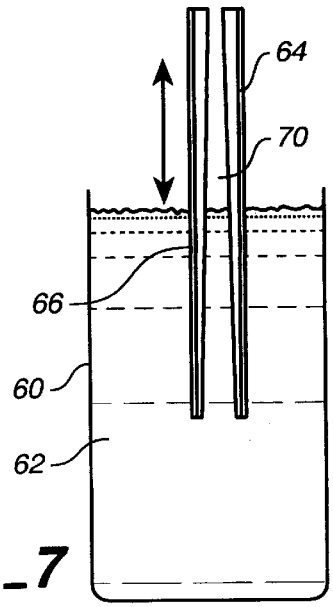
FIG. 7 is a schematic view of a method of creating a tapered bore in a tube.

FIG. 7 is a schematic illustration of a method of making a tapered bore 70 in an etchable tube 64, which may be copper, by repeatedly dipping etchable tube 64 into an etchant 62, which may be hydrochloric acid, confined in an etchant container 60. Since an inertance tube of this invention is only a few millimeters in diameter, etchant container 60 may be a piece of plastic pipe several centimeters in diameter, held in an upright position and closed at its bottom end. The outer surface of etchable tube 64 may be coated with an etchant-proof coating 66, so as to prevent the outer surface of etchable tube 64 from being attacked by etchant 62.

Figure 8:
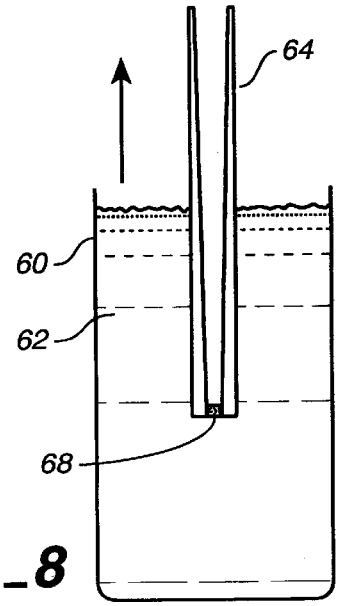
FIG. 8 is a schematic view of a method of tapering the outside of a tube.

FIG. 8 is a schematic illustration of a method of tapering the outside of etchable tube 64 that has been tapered on the inside by the method shown in FIG. 7. An etchant-proof plug 68 is inserted in the bottom end of etchable tube 64 to prevent etchant 62 from entering its bore when etchable tube 64 is lowered into etchant 62.

Operation, FIGS. 3–4

The normal and intuitive way to connect pulse tube 10 to reservoir 20 with inertance tube 41 is to connect one end of inertance tube 41 to pulse tube 10 and connect the other end to reservoir 20 as shown in FIG. 2. However, since the outer wall of inertance tube 41 is open to ambient pressure, it must be strong enough to contain the entire system pressure at its peak.

If inertance tube 41 is placed inside reservoir 20 as shown in FIGS. 3 and 4, the instantaneous pressure differences between the inside and outside surfaces of inertance tube 41 are relatively small. Reservoir 20 must, in any event, contain pressure in the range of several MPa. The pressure fluctuation over a cycle may be a large fraction of one MPa, or more. However, since inertance tube 41 is always subjected to approximately the average system pressure on its outside surface, it need not withstand large pressure differentials. For example, if the average system pressure is 2.0 MPa, pressure in reservoir 20 is close to 2.0 MPa at all times. If the pressure swing in pulse tube 10 is between 1.5 and 2.5 MPa, the maximum pressure difference between pressure inside and outside an unenclosed inertance tube 41 is about 2.5 MPa. If, however, inertance tube 41 is enclosed in reservoir 20, the maximum difference between inside and outside pressure is only about 0.5 MPa, and a much thinner, weaker tubing can be used in fabricating inertance tube 41.

Smooth flow in inertance tube 41 is important to maximize performance of a pulse tube refrigerator. Particularly in small pulse tube refrigerators, fluid friction tends to dampen the inertance effect as fluid flow in inertance tube 41 is impeded by the drag of the tube walls and the entrances and exits at its ends. To minimize adverse fluid friction effects, a smooth passage of fluid into and out of both ends of inertance tube 10 is desirable. Because flow enters and leaves reservoir 20 through the free end of inertance tube 41, that free end may be located so as to allow room for a bell mouth 42 of ideal shape to smooth the flow. Bell mouth 42 shown in FIGS. 3, 4A, 4B and 6 can be formed separately by methods known to the art and joined to the end of inertance tube 41 by convenient methods known to the art including welding, soldering and gluing.

For better thermal conduction with both the configuration shown in FIG. 4A and the configuration shown in FIG. 4B, inertance tube 41 may be bonded to the wall of reservoir 20 by gluing, welding, soldering or brazing. The bonding material provides a heat conduction path from inertance tube to reservoir wall.

Inserting a coiled inertance tube 41 or 48 in reservoir 20 requires an opening in reservoir 20 sufficient to accomodate the coil. If the reservoir 20 is open to its full internal diameter at one end, a coiled inertance tube such as that shown as 41 in FIGS. 3, 4A and 4B and as 48 in FIG. 6 may be inserted. The open end of reservoir 20 may then be closed by attaching it to an end-plug 52 as shown in FIG. 4B. Attachment may be accomplished by any of numerous methods known to the art including bolting, screwing, gluing, soldering, brazing or welding. Joint 50 between end plug 52 and reservoir shell 21 must be fluid-tight. If the attachment method chosen does not also provide a seal, joint 50 may be sealed by "O" rings or other methods known to the art.

Operation, FIGS. 5 and 6

Heretofore, inertance tubes have been made from lengths of tubing, usually extruded, having a constant diameter from end to end. That arrangement, however, is not optimal, particularly in relatively small pulse tube refrigerators in which the inertance tube also serves as the warm heat exchanger. If the inertance tube is small enough enough in diameter to function well as a heat exchanger, viscous effects tend to create large pressure drops, which damp the motion of the fluid passing through and suppress the inertance effect that is the primary purpose of the inertance tube. Moreover, heat transfer occurs at a time in the pressure wave cycle that is less than optimal.

A tapered inertance tube 48 as shown in FIGS. 5 and 6 reduces pressure drop in the portion of inertance tube 48 nearest pulse tube 10, but permits good heat transfer at the end of inertance tube 48 near reservoir 20. That is where hot fluid 12 is pushed while pressure and fluid temperature are high in pulse tube 10. Subsequently, when fluid is returning to pulse tube 10 during the portion of the cycle when pressure in pulse tube 10 is low, fluid flowing from reservoir 20 is cooling as its pressure drops. When fluid temperature falls below the temperature of the wall of inertance tube 48, heat transfer is no longer desired. As cooling fluid flows from reservoir 20 to pulse tube 10, it passes through portions of inertance tube 48 of increasing diameter and reduced heat transfer, which is the desired effect. The taper of the tapered inertance tube 48 thus improves heat transfer characteristics for both directions of flow.

Operation, FIGS. 7 and 8

Most standard methods for making tubing create tubes of uniform diameter and wall thickness. Tapered thin-wall tubing can be created by electroforming a tube on a tapered mandrel and dissolving or melting the mandrel out of the tube after it is formed. However, that process is difficult, expensive and severely limited in the length of tube that can be created.

The method illustrated in FIGS. 7 and 8 begins with an etchable metal tube 64, preferably copper, with a relatively thick wall. Portions of the wall of etchable tube 64 are eroded by immersing it in an etchant container 60 containing an etchant 62 which may be hydrochloric acid. With other tube materials, other etchants or caustic soda may be used. The portions of etchable tube 64 that are in contact with etchant for the longest time are eroded the most. The main difference between the techniques used in tapering the inside and outside of a tube is that to remove material from the bore of a tube, it must be immersed repeatedly, allowing fresh etchant to move into the bore with each immersion. Otherwise, the etchant in the bore will be rapidly depleted and the chemical process by which the etchant removes metal will be halted.

When the external surface of etchable tube 64 is being etched as shown in FIG. 8, etchable tube 64 may be dipped into etchant 62 until only its open top end remains above the level of etchant 62. Etchable tube 64 may then be slowly lifted out of etchant 62, at a rate such that a desired amount of metal is removed from the surface at each point along the length of etchable tube 64.

To prevent removal of tube material from undesired locations in the processes illustrated in FIGS. 7 and 8, etchable tube 64 can be protected with etchant-proof materials. To protect the outside of etchable tube 64 while its bore is being etched, the outer surface of etchable tube 64 may be painted with a suitable coating or wrapped with tape that is not attacked by the etchant chosen. To protect the bore of etchable tube 64 while material is being etched from its outer surface, an etchant-proof plug 68 in the bottom of etchable tube 64 is all that is required to exclude etchant 62 during the etching process.

Although a smoothly-tapered bore in tapered inertance tube 48 of FIGS. 5 and 6 is desirable, some of the benefit of a smooth taper can also be obtained if the diameter of the bore is reduced in steps between lengths of tube of which each is of uniform diameter.

Conclusion, Ramifications and Scope

The advantages of pulse tube refrigerators equipped with inertance tubes are known. Tapering inertance tubes enhances their thermodynamic performance by improving the relationship between heat transfer and pressure drop. Coiling inertance tubes in a reservoir makes inertance tubes practical as a way of controlling flow phasing and heat rejection with high efficiency and with minimal bulk weight and risk of damage or failure.

Although the description above contains many specificities, these should not be construed as limiting the scope of the invention but merely as providing illustrations of some of the presently preferred embodiments of this invention. Thus, the scope of the invention should be determined by the appended claims and their legal equivalents, rather than by the examples given.

I claim:

1. In a pulse tube refrigerator equipped with a reservoir and an inertance tube, said inertance tube having first and second ends, said first end of said inertance tube communicating with the warm end of the pulse tube of said pulse tube refrigerator and said second end of said inertance tube communicating with said reservoir, an improvement comprising a bore of varying cross section in said inertance tube wherein the internal diameter of said bore is greater at said first end of said inertance tube than the internal diameter of said bore at said second end of said inertance tube.

2. The pulse tube refrigerator of claim 1 wherein said bore of said inertance tube is tapered.

3. The pulse tube refrigerator of claim 1 wherein said bore of said inertance tube is stepped.

4. The pulse tube refrigerator of claim 1 wherein said inertance tube is enclosed in said reservoir.

5. The pulse tube refrigerator of claim 1 wherein said inertance tube is enclosed in said reservoir and said inertance tube terminates in a bell mouth.

6. The pulse tube refrigerator of claim 1 wherein said inertance tube is enclosed in said reservoir and said inertance tube is coiled.

7. The pulse tube refrigerator of claim 1 wherein said inertance tube is enclosed in said reservoir and said bore of said inertance tube is tapered.

8. The pulse tube refrigerator of claim 1 wherein said inertance tube is enclosed in said reservoir and said bore of said inertance tube is stepped.

9. In a pulse tube refrigerator equipped with a reservoir, an improvement comprising a coiled inertance tube enclosed within said reservoir, said inertance tube having first and second ends, said first end of said inertance tube communicating with the warm end of the pulse tube of said pulse tube refrigerator and said second end of said inertance tube being open to the interior of said reservoir.

10. The pulse tube refrigerator of claim 9 wherein said second end of said inertance tube terminates in a bell mouth.

11. The pulse tube refrigerator of claim 9 wherein said inertance tube is held in thermal contact with the interior wall of said reservoir by bonding means selected from the group consisting of welding, brazing, soldering and gluing.

12. The pulse tube refrigerator of claim 9 wherein said second end of said inertance tube terminates in a bell mouth, and wherein said inertance tube is held in thermal contact with the interior wall of said reservoir by bonding means selected from the group consisting of welding, brazing, soldering and gluing.

13. The pulse tube refrigerator of claim 9 wherein a straight portion of said inertance tube is interposed between curved portions of said inertance tube.

14. In a pulse tube refrigerator equipped with a reservoir, an improvement comprising an inertance tube enclosed within said reservoir, said inertance tube having first and second ends, said first end of said inertance tube communicating with the warm end of the pulse tube of said pulse tube refrigerator and said second end of said inertance tube being open to the interior of said reservoir, said second end of said inertance tube terminating in a bell mouth.

15. In a pulse tube refrigerator equipped with a reservoir, an improvement comprising an inertance tube enclosed within said reservoir, said inertance tube having first and second ends, said first end of said inertance tube communicating with the warm end of the pulse tube of said pulse tube refrigerator and said second end of said inertance tube being open to the interior of said reservoir wherein a portion of the surface of said inertance tube is held in thermal contact with the interior wall of said reservoir by bonding means selected from the group consisting of welding, brazing, soldering and gluing.

16. In a pulse tube refrigerator equipped with a reservoir, an improvement comprising an inertance tube enclosed within said reservoir, said inertance tube having first and second ends, said first end of said inertance tube communicating with the warm end of the pulse tube of said pulse tube refrigerator and said second end of said inertance tube being open to the interior of said reservoir wherein said inertance tube terminates in a bell mouth and wherein said inertance tube is held in thermal contact with the interior wall of said reservoir by bonding means selected from the group consisting of welding, brazing, soldering and gluing.

17. In a pulse tube refrigerator equipped with a reservoir, an improvement comprising an inertance tube enclosed within said reservoir, said inertance tube having first and second ends, said first end of said inertance tube communicating with the warm end of the pulse tube of said pulse tube refrigerator and said second end of said inertance tube being open to the interior of said reservoir wherein the wall of said inertance tube is too thin to safely contain a pressure equal to the maximum absolute pressure in the pulse tube of said pulse tube refrigerator.

* * * * *